US007710231B2

(12) United States Patent
Akimoto

(10) Patent No.: US 7,710,231 B2
(45) Date of Patent: May 4, 2010

(54) IGNITION COIL

(75) Inventor: Katsunori Akimoto, Okazaki (JP)

(73) Assignee: Denso Corporation, Kariya (JP)

( * ) Notice: Subject to any disclaimer, the term of this patent is extended or adjusted under 35 U.S.C. 154(b) by 49 days.

(21) Appl. No.: 12/183,227

(22) Filed: Jul. 31, 2008

(65) Prior Publication Data

US 2009/0033451 A1 Feb. 5, 2009

(30) Foreign Application Priority Data

Aug. 1, 2007 (JP) ..... 2007-200850

(51) Int. Cl.
*H01F 27/02* (2006.01)

(52) U.S. Cl. ..... 336/92; 336/90; 336/96

(58) Field of Classification Search ..... None
See application file for complete search history.

(56) References Cited

U.S. PATENT DOCUMENTS 4,449,111 A * 5/1984 Nakajima ..... 336/206
5,870,012 A * 2/1999 Sakamaki et al. ..... 336/107
2006/0119459 A1* 6/2006 Skinner et al. ..... 336/96
2008/0007379 A1* 1/2008 Inagaki ..... 336/90

FOREIGN PATENT DOCUMENTS

JP 8-55742 2/1996

* cited by examiner

*Primary Examiner*—Anh T Mai
(74) *Attorney, Agent, or Firm*—Nixon & Vanderhye, PC

(57) ABSTRACT

An ignition coil includes a coil body, a plug connection portion protruding from the coil body, and a connector for electrically connecting the ignition coil to an outside. In the coil body, a primary coil is arranged on an inner peripheral side of a secondary coil, and a center core is arranged on an inner peripheral side of the primary coil. The secondary coil includes a secondary electric wire having thereon an insulating film, wound around an outer periphery of a resinous secondary spool. Furthermore, the connector is formed integrally with an end of the secondary spool in an axial direction.

10 Claims, 6 Drawing Sheets

IGNITION COIL

CROSS REFERENCE TO RELATED APPLICATION

This application is based on Japanese Patent Application No. 2007-200850 filed on Aug. 1, 2007, the contents of which are incorporated herein by reference in its entirety.

FIELD OF THE INVENTION

The present invention relates to an ignition coil that can be used for generating sparks between a pair of electrodes in a spark plug for an internal combustion engine, for example.

BACKGROUND OF THE INVENTION

In an ignition coil used for an internal combustion engine, a primary coil is wound on a resinous primary spool and a secondary coil is wound on a resinous secondary spool. The primary and secondary coils are accommodated in a resinous coil case to form the ignition coil. The primary coil can be formed in a cylindrical shape using a self-fusing copper wire without the primary spool.

For example, JP-A-8-55742 discloses a coil case of an ignition coil for an internal combustion engine. The coil case is constructed by integrally forming a container for accommodating therein a transformer for generating a high voltage, a cylindrical primary bobbin for holding a primary winding of the transformer, and a connector for connection of an electric signal with an external device for controlling the high voltage. The primary winding using the self-fusing wire is mounted on the primary bobbin.

However, in the conventional ignition coil as disclosed in JP-A-8-55742, a secondary spool (secondary bobbin) and the connector for connecting the ignition coil to an external electronic control unit (ECU) or the like are separately molded and assembled. This arrangement is not sufficient to decrease the number of components of the ignition coil. When the secondary spool is assembled to the connector, measures are required in order to stably connect a low-voltage side winding end of the secondary coil wound on the secondary spool to a terminal (or a fitting member) for connection with a conducting pin of the connector.

SUMMARY OF THE INVENTION

The invention has been made in view of the forgoing problems, and it is an object of the invention to provide an ignition coil that can simplify the structure of a wire connection portion of a secondary coil, thereby effectively decreasing the number of components of the ignition coil.

According to an aspect of the present invention, an ignition coil includes a coil body, a plug connection portion and a connector. The coil body includes a center core made of a soft magnetic material, a primary coil and a secondary coil, which are accommodated in a coil case. The plug connection portion is provided to protrude from the coil body, and is adapted to bring a high-voltage side winding end of the secondary coil into conduction with a spark plug. The connector is for electrically connecting the coil body to an outside of the coil case. In the ignition coil, the primary coil is arranged on an inner peripheral side of the secondary coil, and the center core is arranged on an inner peripheral side of the primary coil. The secondary coil includes a secondary electric wire having thereon an insulating film, wound around an outer periphery of a resinous secondary spool. In addition, the connector is formed integrally with an end of the secondary spool in an axial direction.

Accordingly, it is possible to eliminate a step of assembling the secondary spool and the connector. Thus, a terminal (a fitting member) for connecting a low-voltage side winding end of the secondary coil wound on the secondary spool to a conducting pin in the connector can be provided in an integrated molded member including the secondary spool and the connector, for example. In this case, in the secondary spool and the connector, there are no need to separately provide the terminals for connecting the low-voltage side winding end of the secondary coil to the conducting pin of the connector.

As a result, the ignition coil can simplify the structure of a wire connection portion of the secondary coil, thereby effectively decreasing the number of components in the ignition coil.

BRIEF DESCRIPTION OF THE DRAWINGS

Additional objects and advantages of the present invention will be more readily apparent from the following detailed description of preferred embodiments when taken together with the accompanying drawings. In which.

DETAILED DESCRIPTION OF THE PREFERRED EMBODIMENTS

Figure 1:
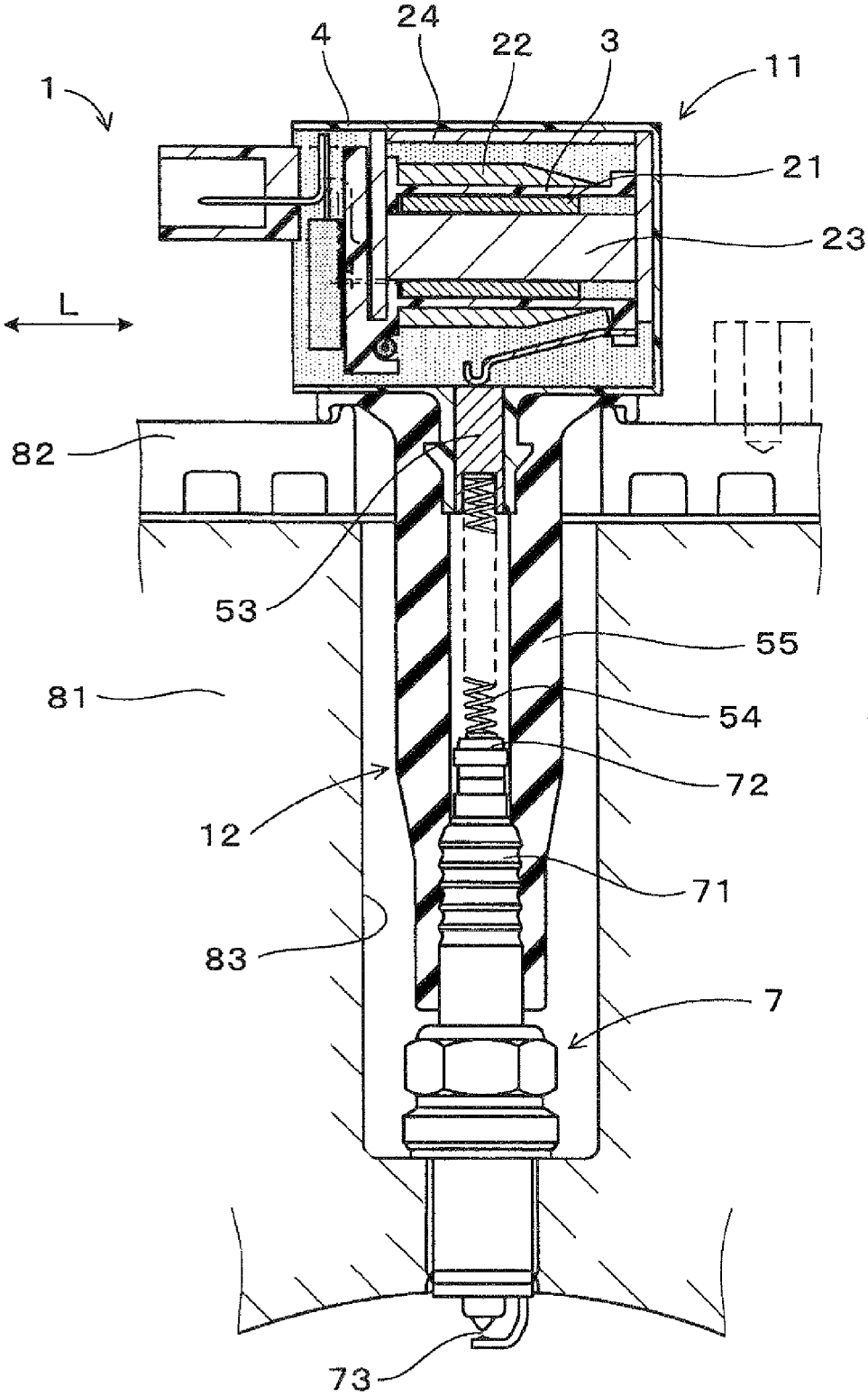
FIG. 1 is a schematic sectional view showing an entire structure of an ignition coil arranged in a plug hole according to an embodiment of the invention.

According to a preferred embodiment of the present invention, an ignition coil (1) includes a coil body (11), a plug connection portion (12) and a connector (31). The coil body (11) includes a center core (23) made of a soft magnetic material, a primary coil (21) and a secondary coil (22), which are accommodated in a coil case (4). The plug connection portion (12) is provided to protrude from the coil body (11), and is adapted to bring a high-voltage side winding end of the secondary coil (22) into conduction with a spark plug (7). The connector (31) is for electrically connecting the coil body (11) and the plug connection portion (12) to an outside of the coil case (4). In the ignition coil (1), the primary coil (21) is arranged on an inner peripheral side of the secondary coil (22), and the center core (23) is arranged on an inner peripheral side of the primary coil (21). The secondary coil (22) includes a secondary electric wire having thereon an insulating film, wound around an outer periphery of a resinous secondary spool (3). In addition, the connector (31) is formed integrally with an end of the secondary spool (3) in an axial direction (L). Accordingly, it is possible to eliminate the step of assembling the secondary spool (3) and the connector (31).

Preferably, the ignition coil (1) includes an igniter arrangement portion (32) for arranging an igniter (321) including a switching control circuit for energization and non-energization to the primary coil (21). In this case, the igniter arrangement portion (32) is formed integrally with the secondary spool (3), and the connector (31) is formed integrally with the igniter arrangement portion (32) and the secondary spool (3) while protruding from the igniter arrangement portion (32). Accordingly, the ignition coil (1) can simplify the structure of a wire connection portion of the secondary coil (22), thereby effectively decreasing the number of components in the ignition coil (1).

More preferably the ignition coil (1) includes conducting members (34, 35) insert-molded into the igniter arrangement portion (32) and the connector (31). For example, the conducting members (34, 35) are adapted to bring a positive side winding end and a negative side winding end of the primary coil (21) and a low-voltage side winding end of the secondary coil (22) into conduction with conducting pins (311, 322) of the igniter (321). In this case, the ignition coil (1) can simplify the structure of the wire connection portion of the primary coil (21), the secondary coil (22) and the igniter (321), by using the conducting members (34, 35) insert-molded into the igniter arrangement portion (32) and the connector (31).

For example, the ignition coil (1) further includes an outer peripheral core (24) made of a soft magnetic material and arranged on an outer peripheral side of the secondary coil (22), and an intermediate core (25) made of a soft magnetic material and arranged between the outer peripheral core (24) and an axial end of the center core (23). In this case, the intermediate core (25) is arranged in a core arrangement concave portion (323) that is provided between the axial end of the secondary spool (3) and the igniter arrangement portion (32). In this case, an electromagnetic circuit constructed of the center core (23), the outer peripheral core (24) and the intermediate core (25) can be formed by effectively using a space in the coil case (4).

The plug connection portion (12) can be arranged perpendicularly to the axial direction of the coil body (11) to protrude from an intermediate position in the axial direction of the coil body (11). In this case, the outer peripheral core (24) has a C-like sectional shape with a cutout portion (241) arranged on a side of the plug connection portion (12). Furthermore, the secondary spool (3) can be provided to have on the side of the cutout portion (241), a low-voltage side terminal (52) provided on one end side in the axial direction (L) and electrically connected to a low-voltage side winding end of the secondary coil (22), and a high-voltage side terminal (51) provided on the other end side in the axial direction (L) and electrically connected to a high-voltage side winding end (221) of the secondary coil (22).

Furthermore, the low-voltage side terminal (52) can be formed using a diode terminal connected to the secondary coil (22). In this case, because the diode terminal connected to the secondary coil (22) is used, it is unnecessary to additionally provide a low-voltage side terminal.

Preferably, the primary coil (21) includes a primary electric wire wound in a cylindrical shape and fusion-bonded by a fusing agent, and is directly arranged on an outer peripheral side of the center core (23). Generally, the coil case can be made of resin.

In the above ignition coil (1), the igniter arrangement portion (32), the secondary spool (3) and the connector (31) can be molded integrally by using resin, and the connector (31) can protrude from the igniter arrangement portion (32) in a direction approximately parallel with the axial direction (L).

Typical Example of Embodiment

Now, a typical example of an ignition coil according to an embodiment of the invention will be described below with reference to the accompanying drawings.

As shown in FIG. 1, an ignition coil 1 of this embodiment includes a coil body 11 for accommodating a primary coil 21 and a secondary coil 22 stacked on the respective inner and outer peripheral sides in a resinous coil case 4. The ignition coil 1 also includes a plug connection portion 12 extending in a direction approximately perpendicular to an axial direction L of the coil body 11 and adapted to bring a high-voltage side winding end 221 of the secondary coil 22 into conduction with a spark plug 7. In the ignition coil 1, the plug connection portion 12 is arranged and inserted into a plug hole 83 provided in a cylinder head 81 and a cylinder head cover 82 of the engine, and the coil body 11 is transversely arranged near an opening of the plug hole 83 in the cylinder head cover 82.

Figure 2:
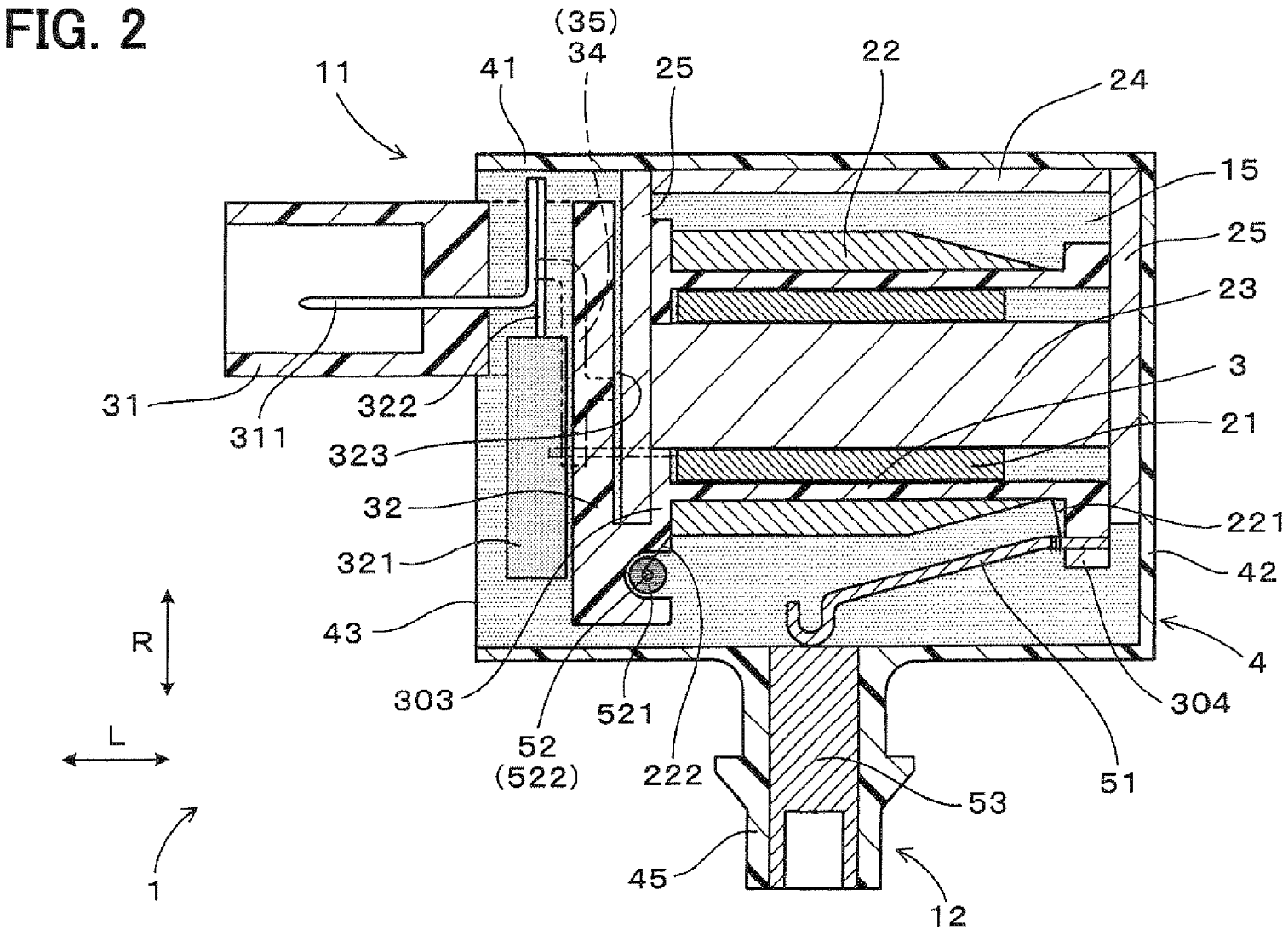
FIG. 2 is a schematic sectional view showing the ignition coil of the embodiment before being arranged in the plug hole.
Figure 3:
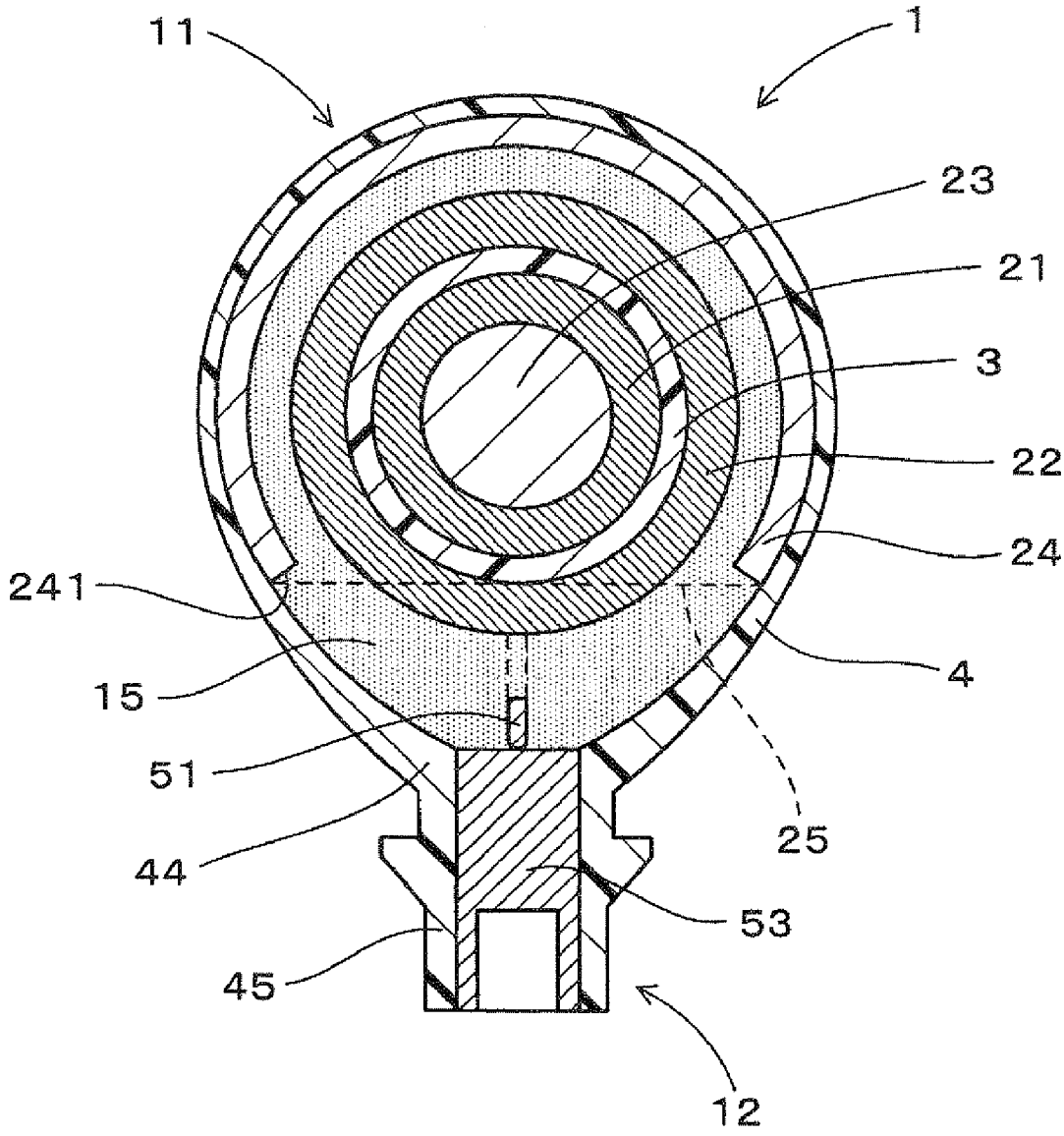
FIG. 3 is another schematic sectional view showing the ignition coil of the embodiment before being arranged in the plug hole.

As shown in FIGS. 2 and 3, the primary coil 21 is arranged on the inner peripheral side of the secondary coil 22. A center core 23 made of a soft magnetic material is arranged on the inner peripheral side of the primary coil 21. The plug connection portion 12 is provided to protrude from an intermediate position in the axial direction L of the coil body 11. In this example shown in FIG. 1, the plug connection portion 12 is located to protrude substantially from the center position of the coil case 4 in the axial direction L.

Figure 4:
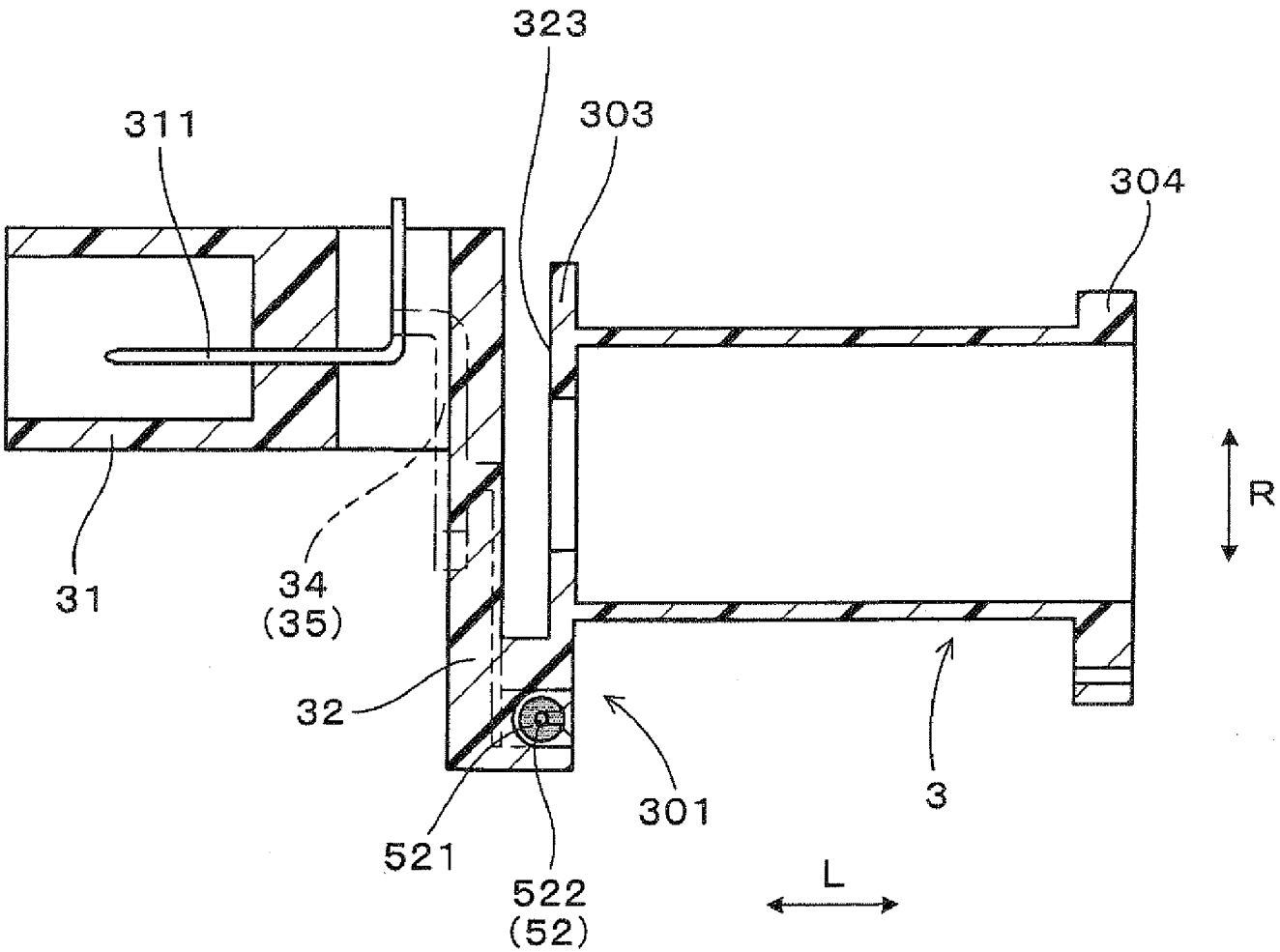
FIG. 4 is a schematic sectional view showing a secondary spool before being assembled to the ignition coil in the embodiment.

The secondary coil 22 is constructed by winding a secondary electric wire having an insulating film, around the outer periphery of a resinous secondary spool 3. A connector 31 for electrically connecting the ignition coil 1 to an external electronic control unit (ECU) or the like is integrally formed with one end 301 of the secondary spool 3 in the axial direction L, as shown in FIGS. 2 and 4.

FIG. 1 shows an entire structure of the ignition coil 1 according to this embodiment. FIGS. 2 and 3 show the ignition coil 1 before assembly of a spring 54 and a plug cap 55 as described later, and before being arranged in the plug hole 83.

The ignition coil 1 of this embodiment will be described below in detail with reference to FIGS. 1 to 6.

As shown in FIGS. 1 to 3, the plug connection portion 12 in the ignition coil 1 of this embodiment includes a mounting base 45 formed to protrude from the outer periphery of the coil case 4, a conducting terminal 53 provided in the mounting base 45, a rubber plug cap 55 mounted onto the mounting base 45, and the coil spring 54 arranged in the plug cap 55.

The spark plug 7 is screwed into a bottom portion of the plug hole 83 of the cylinder head 81, and the plug cap 55 of the ignition coil 1 is mounted to an insulator 71 of the spark plug 7, so that the lower end of the coil spring 54 is brought into conduction with a terminal 72 positioned at the tip of the insulator 71 of the spark plug 7. At this time, the high-voltage side winding end 221 of the secondary coil 22 is brought into conduction with the end of the spark plug 7 via a high voltage terminal 51, the conducting terminal 53, and the coil spring 54.

As shown in FIGS. 2 and 3, an outer peripheral core 24 made of a soft magnetic material is arranged on the outer peripheral side of the secondary coil 22 in the coil body 11 of the ignition coil 1 of this embodiment. Intermediate cores 25 made of a soft magnetic material are arranged between the outer peripheral core 24 and the two ends of the center core 23 in the axial direction L. The outer peripheral core 24 has a C-like sectional shape with a cutout portion 241 arranged on the side of the plug connection portion 12.

The center core 23 is formed to have a substantially circular sectional shape by laminating a plurality of plate-like electromagnetic steel plates (e.g., silicon steel plates or the like) in the radial direction R. As shown in FIG. 2, the radial direction R is a direction perpendicular to the axial direction L. The outer peripheral core 24 is constructed of a lamination of the electromagnetic steel plates (e.g., silicon steel plates or the like) in the radial direction R, each having a C-like sectional shape along the shape of the inner peripheral surface of the coil case 4. The outer peripheral core 24 has the cutout portion 241 formed over the entire length thereof in the axial direction L. That is, as shown in FIG. 3, the cutout portion 241 is an opening formed in the outer peripheral core 24. The cutout portion 241 is open in a direction facing the plug connection portion 12. The outer peripheral core 24 is arranged on the inner peripheral surface of the coil case 4.

The primary core 21 of this embodiment is constructed of a primary electric wire, which is a self-fusing wire, wound in a cylindrical shape without using the resinous primary spool and fusion-bonded by a fusing agent of the self-fusing wire. The primary core 21 is directly arranged on the outer peripheral side of the center core 23. The primary electric wire is wound on a stick-like jig in a cylindrical shape, and then energized to be heated. Thus, the primary core is fusion-bonded by the fusing agent on the surface thereof to be molded in a cylindrical shape, so that the primary coil 21 can be formed by being removed from the jig.

As shown in FIG. 2, the secondary spool 3 with the secondary coil 22 wound thereon has flanges 303 and 304 located on both ends thereof in the axial direction L and protruding outward in the radial direction R. The secondary electric wire is wound between the flanges 303 and 304. The secondary electric wire has a diameter smaller than that of the primary electric wire, and the number of winding of the secondary wire is larger than that of the primary electric wire.

As shown in FIGS. 2 and 4, an igniter arrangement portion 32 is integrally formed with the one end 301 of the secondary spool 3 in the axial direction L, in this embodiment. The igniter arrangement portion 32 is adapted to arrange an igniter 321 including a switching control circuit for energization and non-energization to the primary coil 21. The connector 31 is integrally formed with the igniter arrangement portion 32 and the secondary spool 3, while protruding from the igniter arrangement portion 32 in the axial direction L. A plurality of conducting pins 311 are insert-molded into the connector 31.

A core arrangement concave portion 323 for arranging one intermediate core 25 is formed between the secondary spool 3 and the igniter arrangement portion 32. The connector 31 is formed to protrude from the igniter arrangement portion 32, and has the conducting pins 311 directed toward the axial direction L.

FIG. 4 shows the secondary spool 3 before being assembled to the ignition coil 1.

As shown in FIG. 2, the coil case 4 has a bottom 42 on one end (e.g., right end in FIG. 2) of a cylindrical outer peripheral portion 41 in the axial direction L, and an opening 43 at the other end thereof. At the inner surface of the bottom 42 of the coil case 4, the other intermediate core 25 is arranged. The coil case 4 has a protruding outer peripheral portion 44 protruding from a part of the outer peripheral portion 41 outward the plug connection portion 12 in the radial direction R. The mounting base 45 is formed to protrude from the protruding outer peripheral portion 44, in the plug connection portion 12.

The connector 31 is arranged to protrude from the opening 43 of the coil case 4 in the axial direction L.

The secondary spool 3 has on the plug connection portion 12 side (i.e., on the cutout portion 241 side of the outer peripheral core 24), a low-voltage side terminal 52 which is electrically connected to a low-voltage side winding end 222 of the secondary coil 22, and the high-voltage side terminal 51 which is electrically connected to the high-voltage side winding end 221 of the secondary coil 22.

The secondary coil 22 of this embodiment is formed by wiring the secondary electric wire toward the other end of the secondary spool 3 in the axial direction L in a diagonally wound state where a reduced winding part and an enlarged winding part are superimposed on each other In the reduced winding part, the secondary electric wire is wound with a winding diameter decreasing from one end side to the other end side of the secondary spool 3 in the axial direction L. In the enlarged winding part, the secondary electric wire is wound with a winding diameter increasing from the other end side to the one end side of the secondary spool 3 in the axial direction L.

As shown in FIG. 2, the high-voltage side terminal 51 of this embodiment is formed to extend from the other flange 304 of the secondary spool 3 toward an intermediate position of the coil case 4. That is, the high-voltage side terminal 51 extends from the other flange 304 to the conducting terminal 53 that is located in the mounting base 45.

In the mounting base 45, the conducting terminal 53 is provided for bringing the high-voltage side terminal 51 into conduction with the coil spring 54.

Figure 6:
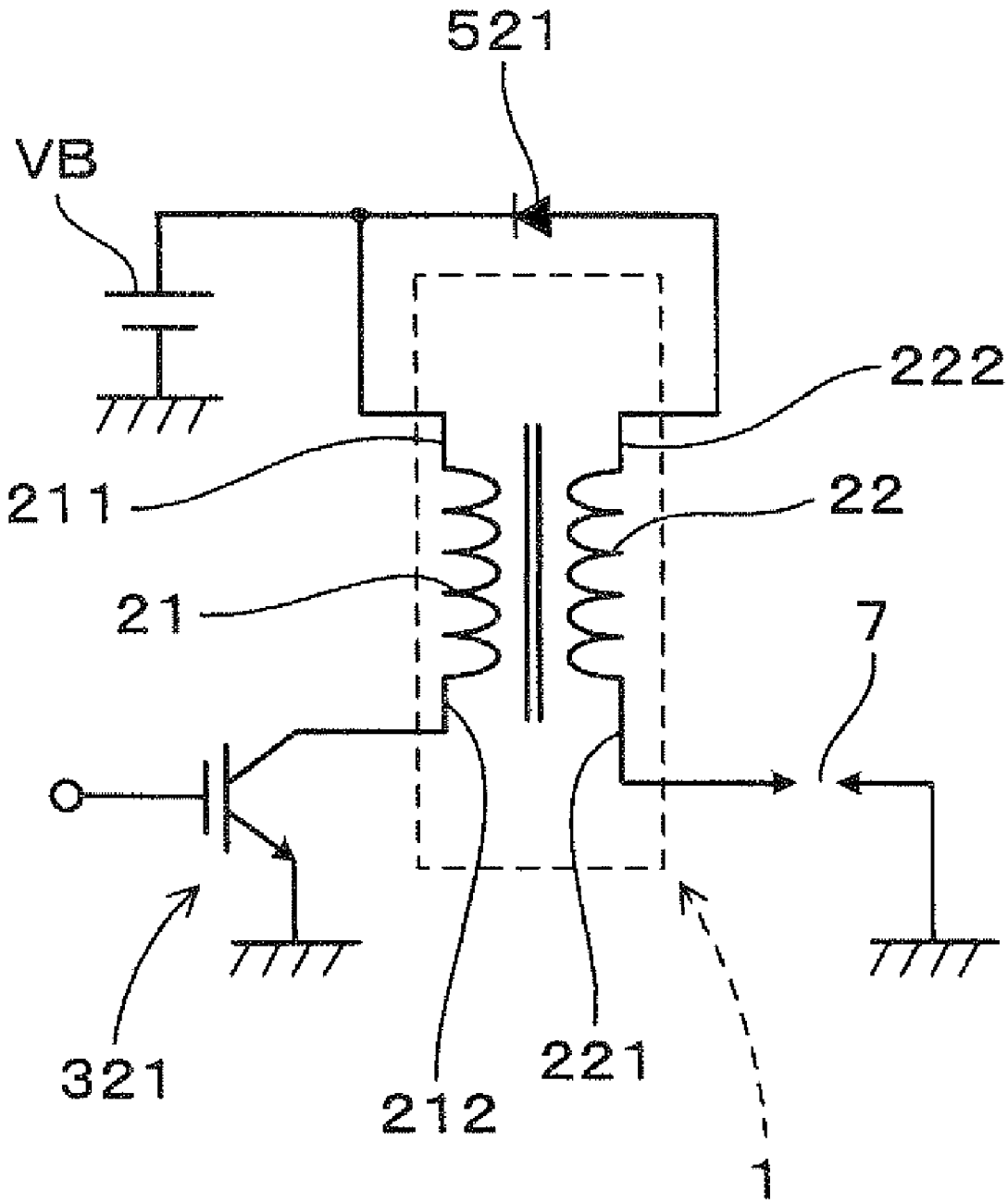
FIG. 6 is a schematic diagram showing a circuit configuration of the ignition coil in the embodiment.

FIG. 6 schematically shows a circuit configuration of the ignition coil 1 of this embodiment. A positive side winding end 211 of the primary coil 21 is connected to a battery power source VB, and a negative side winding end 212 of the primary coil 21 is connected to a switching element in the switching control circuit of the igniter 321. The low-voltage side winding end 222 of the secondary coil 22 is connected to an anode terminal of a diode 521, and a cathode terminal of the diode 521 is connected to the battery power source VB and the positive winding end 211 of the primary coil 21.

Figure 5:
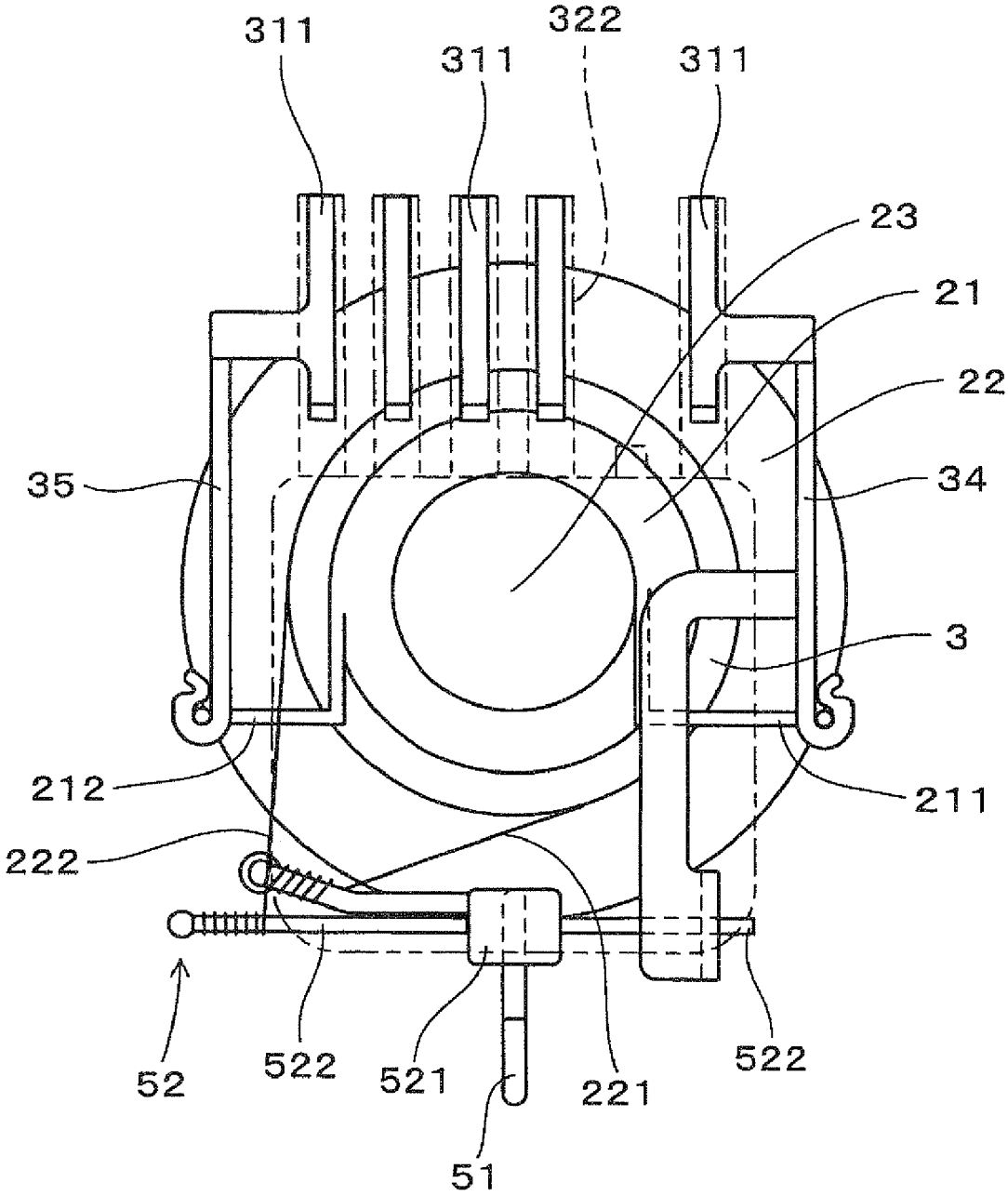
FIG. 5 is a schematic diagram showing a state in which terminals provided in electric connection portions of primary and secondary coils, conducting pins, and the like are formed in the embodiment.

As shown in FIGS. 5 and 6, the low-voltage side terminal 52 of this embodiment is formed by diverting a terminal 522 of the diode 521 such that an induced electromotive force caused in the secondary coil 22 is not applied to the spark plug 7 at start of energization to the primary coil 21. The igniter arrangement portion 32 is provided with a first conducting member 34 for attaching the diode 521. The diode 521 can be attached to the igniter arrangement portion 32 formed, and thus can be insert-molded into the igniter arrangement portion 32.

One terminal 522 of the diode 521 is connected to the first conducting member 34, and the other terminal 522 of the diode 521 is connected to the low-voltage side winding end 222 of the secondary coil 22. The first conducting member 34 is connected to the positive side winding end 211 of the primary coil 21.

FIG. 5 shows the formed state of the terminals 51 and 52, the conducting pins 311 and 322, and the like which are provided in electrical connection parts of the primary coil 21 and the secondary coil 22.

In the igniter arrangement portion 32, a second conducting member 35 connected to the negative side winding end 212 of the primary coil 21 is provided on the side opposite to the side of the first conducting member 34.

The conducting pin 322 of the igniter 321 is connected to the conducting pin 311 of the connector 31 by welding or the like. Each of the first conducting member 34 and the second conducting member 35 is integrally formed with one of the conducting pins 311 of the connector 31.

As shown in FIGS. 2 and 3, a clearance of the ignition coil 1 enclosed by the coil case 4 is filled with a thermosetting resin (e.g., epoxy resin or the like) 15 for fixing and insulating of respective components which include the primary coil 21, the secondary coil 22, the center core 23, the outer peripheral core 24, the intermediate core 25, the igniter 321, and the like.

After assembly of the respective components of the ignition coil 1, the inside of the clearance of the ignition coil 1 is brought into a vacuum state, and then filled with the liquid thermosetting resin 15, which becomes thereafter hardened.

When a command is received from an ECU in the ignition coil 1 of this embodiment to energize the primary coil 21 by the switching control circuit of the igniter 321, a magnetic field is formed to pass through the center core 23, the intermediate core 25, and the outer peripheral core 24. Then, when the energization to the primary coil 21 is interrupted, a voltage is generated in the primary coil 21 by a self-induction effect, while a high induced electromotive force is generated in the secondary coil 22 by a mutual induction effect, so that a spark can be made between a pair of electrodes 73 in the spark plug 7 that is provided in the ignition coil 1 (see FIG. 1).

In the ignition coil 1 of this embodiment as described above, the igniter arrangement portion 32 and the connector 31 are integrally formed with the one end 301 of the secondary spool 3 in the axial direction L.

Accordingly, it is unnecessary to have a step of assembling the secondary spool 3 to the igniter arrangement portion 32 and the connector 31. The first conducting member 34 is adapted to connect the low-voltage side winding end 222 of the secondary coil 22 and the positive side winding end 211 of the primary coil 21 to the conducting pin 311 in the connector 31. The second conducting member 35 is adapted to connect the negative side winding end 212 of the primary coil 21 to the conducting pin 311 of the connector 31. The first and second conducting members 34 and 35 can be insert-molded into the connector 31 and the igniter arrangement portion 32 which are integrally formed with the secondary spool 3 using the resin. Thus, there is no need to separately provide the first conducting member 34 and the second conducting member 35, in each of the secondary spool 3 and the connector 31.

Thus, the ignition coil 1 of this embodiment can simplify the structure of the wire connection portion of the secondary coil 22, thereby effectively decreasing the number of components of the ignition coil 1.

Although the present invention has been fully described in connection with the preferred embodiments with reference to the accompanying drawings it is to be noted that various changes and modifications will become apparent to those skilled in the art. such changes and modifications are to be understood as being within the scope of the present invention as defined by the appended claims.

What is claimed is:

1. An ignition coil comprising:

a coil body including a center core made of a soft magnetic material, a primary coil and a secondary coil, which are accommodated in a coil case;

a plug connection portion protruding from the coil body, the plug connection portion being adapted to bring a high-voltage side winding end of the secondary coil into conduction with a spark plug;

a connector for electrically connecting the coil body to an outside of the coil case;

an igniter arrangement portion for arranging an igniter including a switching control circuit for energization and non-energization to the primary coil;

an outer peripheral core made of a soft magnetic material and arranged on an outer peripheral side of the secondary coil; and an intermediate core made of a soft magnetic material and arranged between the outer peripheral core and an end of the center core in the axial direction, wherein the primary coil is arranged on an inner peripheral side of the secondary coil, and the center core is arranged on an inner peripheral side of the primary coil, wherein the secondary coil includes a secondary electric wire having thereon an insulating film, wound around an outer periphery of a resinous secondary spool, wherein the connector is formed integrally with an end of the secondary spool in an axial direction, wherein the igniter arrangement portion is formed integrally with the secondary spool, wherein the connector is formed integrally with the igniter arrangement portion and the secondary spool, while protruding from the igniter arrangement portion, and wherein the intermediate core is arranged in a core arrangement concave portion that is provided between the end of the secondary spool in the axial direction and the igniter arrangement portion.

2. The ignition coil according to claim 1, further comprising conducting members insert-molded into the igniter arrangement portion and the connector, the conducting members being adapted to bring a positive side winding end and a negative side winding end of the primary coil and a low-voltage side winding end of the secondary coil into conduction with conducting pins of the igniter.

3. The ignition coil according to claim 1, wherein the primary coil includes a primary electric wire wound in a cylindrical shape and fusion-bonded by a fusing agent, and is directly arranged on an outer peripheral side of the center core.

4. The ignition coil according to claim 1, wherein the coil case is made of resin.

5. The ignition coil according to claim 1, wherein the igniter arrangement portion, the secondary spool and the connector are molded integrally by using resin, and wherein the connector protrudes from the igniter arrangement portion in a direction approximately parallel with the axial direction.

6. An ignition coil comprising:

a coil body including a center core made of a soft magnetic material, a primary coil and a secondary coil, which are accommodated in a coil case;

a plug connection portion protruding from the coil body, the plug connection portion being adapted to bring a high-voltage side winding end of the secondary coil into conduction with a spark plug;

a connector for electrically connecting the coil body to an outside of the coil case; and an outer peripheral core arranged on an outer peripheral side of the secondary coil, wherein the primary coil is arranged on an inner peripheral side of the secondary coil, and the center core is arranged on an inner peripheral side of the primary coil; and wherein the secondary coil includes a secondary electric wire having thereon an insulating film, wound around an outer periphery of a resinous secondary spool, wherein the connector is formed integrally with an end of the secondary spool in an axial direction, wherein the plug connection portion is arranged perpendicularly to the axial direction of the coil body to protrude from an intermediate position in the axial direction of the coil body, wherein the outer peripheral core has a C-like sectional shape with a cutout portion arranged on a side of the plug connection portion, and wherein the secondary spool has on the side of the cutout portion, a low-voltage side terminal provided on one end side in the axial direction and electrically connected to a low-voltage side winding end of the secondary coil, and a high-voltage side terminal provided on the other end side in the axial direction and electrically connected to a high-voltage side winding end of the secondary coil.

7. The ignition coil according to claim 6, wherein the low-voltage side terminal is formed using a diode terminal connected to the secondary coil.

8. The ignition coil according to claim 6, wherein the primary coil includes a primary electric wire wound in a cylindrical shape and fusion-bonded by a fusing agent, and is directly arranged on an outer peripheral side of the center core.

9. The ignition coil according to claim 6, wherein the coil case is made of resin.

10. The ignition coil according to claim 6, wherein the igniter arrangement portion, the secondary spool and the connector are molded integrally by using resin, and wherein the connector protrudes from the igniter arrangement portion in a direction approximately parallel with the axial direction.

* * * * *